US006200942B1

(12) United States Patent
Stols

(10) Patent No.: US 6,200,942 B1
(45) Date of Patent: Mar. 13, 2001

(54) CLEANING COMPOSITION

(76) Inventor: Magdelena Christiana Cornelia Stols, P O Box 5191, Greenfields 5208 (ZA)

( * ) Notice: Subject to any disclaimer, the term of this patent is extended or adjusted under 35 U.S.C. 154(b) by 0 days.

(21) Appl. No.: 09/359,501

(22) Filed: Jul. 23, 1999

(30) Foreign Application Priority Data

Jul. 23, 1998 (ZA) ..... 98/6597
Feb. 18, 1999 (ZA) ..... 99/1306

(51) Int. Cl.[7] ..... C23G 1/02

(52) U.S. Cl. ..... 510/245; 510/253; 510/254; 510/255; 510/258; 510/477; 134/41

(58) Field of Search ..... 510/245, 253, 510/254, 255, 258; 134/477, 41

(56) References Cited

U.S. PATENT DOCUMENTS

| | | | | |
|---|---|---|---|---|
| 2,628,199 | * | 2/1953 | Lowenheim . | |
| 2,847,384 | * | 8/1958 | Conklin et al. . | |
| 2,994,664 | * | 8/1961 | Wachter . | |
| 4,155,868 | | 5/1979 | Kaplan et al. | 252/95 |
| 4,851,149 | * | 7/1989 | Carandang . | |
| 4,970,015 | | 11/1990 | Garcia | 252/79.4 |
| 5,451,335 | * | 9/1995 | Hieatt et al. . | |
| 5,490,949 | | 2/1996 | Backes et al. | 252/174 |
| 5,902,411 | * | 5/1999 | Williams et al. . | |
| 5,958,854 | * | 9/1999 | Laing et al. . | |

FOREIGN PATENT DOCUMENTS

| | | |
|---|---|---|
| 0010412 | 4/1980 | (EP) . |
| 2542197 | 9/1984 | (FR) . |
| 709392 | 5/1954 | (GB) . |
| 722255 | 1/1955 | (GB) . |
| 763547 | 12/1956 | (GB) . |
| 913343 | 12/1962 | (GB) . |
| 1049049 | 11/1966 | (GB) . |
| 1203722 | 9/1970 | (GB) . |
| 1217414 | 12/1970 | (GB) . |
| 2313844 | 12/1997 | (GB) . |
| 54-106509 | 8/1979 | (JP) . |
| 9423002 | 10/1994 | (WO) . |
| 9802139 | 1/1998 | (WO) . |

OTHER PUBLICATIONS

English Abstract of FR 2542197 Dated Sep. 14, 1984.
English Abstract of JP 54106509 dated Aug. 21, 1979.

* cited by examiner

*Primary Examiner*—Margaret Einsmann
(74) *Attorney, Agent, or Firm*—Ladas & Parry

(57) ABSTRACT

A cleaning composition that can be dissolved in water to form a cleaning solution for cleaning metal articles, comprises 10% (m/m) iodine, 65% (m/m) tartaric acid, 5% (m/m) sodium lauryl sulphate and 20% (m/m) citric acid. The cleaning solution can be applied to the surface of a metal article for cleaning it. The invention extends to the cleaning solution which includes 20 grams of the chemical composition dissolved in one litre of water.

12 Claims, No Drawings

CLEANING COMPOSITION

FIELD OF THE INVENTION

THIS INVENTION relates to a cleaning composition. It relates particularly to a cleaning composition for cleaning metal articles. It also relates to a cleaning solution including the cleaning composition.

SUMMARY OF THE INVENTION

According to a first aspect of the invention there is provided a cleaning composition that can be dissolved in water to form a cleaning solution for cleaning metal articles, the cleaning composition comprising, in combination, an effective amount of tartaric acid; and an effective amount of a water soluble cleaning agent.

The cleaning agent may be a surfactant.

The cleaning agent may be in the form of soap.

The cleaning agent may be sodium lauryl sulphate.

The cleaning composition may include citric acid in an amount effective particularly for cleaning brass articles.

The cleaning composition may include iodine in an amount effective for providing a metal article cleaned by the cleaning composition with a shiny surface coating.

The cleaning composition may include 5% to 15% (m/m) iodine, 55% to 75% (m/m) tartaric acid, 3% to 10% (m/m) sodium lauryl sulphate and 10% to 30% (m/m) citric acid.

More specifically, the cleaning composition may include 10% (m/m) iodine, 65% (m/m) tartaric acid, 5% (m/m) sodium lauryl sulphate and 20% (m/m) citric acid.

The cleaning composition may be provided in the form of a dry powder.

According to a second aspect of the invention there is provided a cleaning solution for cleaning metal articles, comprising water having a cleaning composition including an effective amount of tartaric acid and an effective amount of a cleaning agent, dissolved therein.

The cleaning agent may be a surfactant.

The cleaning agent may be in the form of soap.

The cleaning agent may be sodium lauryl sulphate.

The cleaning composition may include citric acid in an amount effective particularly for cleaning articles having a brass surface to be cleaned.

The cleaning solution may include iodine in an amount effective for providing a metal article cleaned by the cleaning solution with a shiny surface coating.

The cleaning composition may include 5% to 15% (m/m) iodine, 55% to 75% tartaric acid, 3% to 10% (m/m) sodium lauryl sulphate and 10% to 30% (m/m) citric acid. More specifically, the cleaning composition may include 10% (m/m) iodine, 65% (m/m) tartaric acid, 5% (m/m) sodium lauryl sulphate and 20% (m/m) citric acid.

The cleaning solution may comprise 20 grams of the cleaning composition dissolved in one litre of water.

DETAILED DESCRIPTION OF THE PREFERRED EMBODIMENTS

Further features of a cleaning composition for cleaning metal articles and a cleaning solution including the cleaning composition, are described hereinafter with reference to a non-limiting example of the invention.

A cleaning composition for cleaning metal articles, in accordance with the invention, comprises 10% (m/m) iodine, 65% (m/m) tartaric acid, 5% (m/m) sodium lauryl sulphate and 20% (m/m) citric acid. The tartaric acid, in combination with the sodium lauryl sulphate, is effective in cleaning the surfaces of metal articles of a wide range of different metals. The iodine is effective in providing a metal article cleaned by the chemical composition, with a shiny surface coating. The citric acid is particularly effective for cleaning brass articles and thus permits the cleaning solution to be used for cleaning a wide range of articles of different metals.

The sodium lauryl sulphate is a surfactant and wetting agent and has a neutral pH.

In order to provide for the cleaning of metal articles, the Applicant envisages that approximately 20 g of the chemical composition can be dissolved in approximately 1 liter of water to form a cleaning solution in accordance with the invention. The cleaning solution is applied to the surfaces of metal articles to be cleaned, by submerging the metal articles in a container of the cleaning solution for approximately one minute. The metal articles are then removed from the solution and wiped dry by means of a cloth or the like. The Applicant envisages that larger metal articles that are too large to be submerged in a container of the cleaning solution can merely be cleaned by having the cleaning solution applied thereto by means of a sponge, cloth or the like, and thereafter wiped dry as described hereinabove.

What is claimed is:

1. A cleaning composition formulated as a water-soluble composition that can be dissolved in water to form a cleaning solution for cleaning the surfaces of metal articles, the cleaning composition including, in combination, 55% to 75% (m/m) tartaric acid as an active cleaning ingredient;

10% to 30% (m/m) citric acid as an active cleaning ingredient;

3% to 10% (m/m) of a surfactant; and optionally further additives.

2. A cleaning composition as claimed in claim 1, which is formulated as a water-soluble dry powder.

3. A cleaning composition as claimed in claim 1, wherein the surfactant is in the form of soap.

4. A cleaning composition as claimed in claim 1, wherein the surfactant is sodium lauryl sulphate.

5. A cleaning composition as claimed in claim 1, wherein the cleaning composition includes iodine as a further additive in an amount effective for providing a metal article cleaned by the cleaning solution, in use, with a shiny surface coating.

6. A cleaning composition as claimed in claim 5, which includes approximately: 10% (m/m) iodine, 65% (m/m) tartaric acid, 5% (m/m) sodium lauryl sulphate and 20% (m/m) citric acid.

7. A cleaning solution for cleaning the surfaces of metal articles, the cleaning solution including water having dissolved therein a cleaning composition including, in combination, 55% to 75% (m/m) tartaric acid as an active cleaning ingredient;

10% to 30% (m/m) citric acid as an active cleaning ingredient;

3% to 10% (m/m) of a surfactant; and optionally further additives.

8. A cleaning solution as claimed in claim 7, wherein the surfactant is in the form of soap.

9. A cleaning solution as claimed in claim 7, wherein the surfactant is sodium lauryl sulphate.

10. A cleaning solution as claimed in claim 7, wherein the cleaning solution comprises approximately 20 grams of the cleaning composition per litre of water.

11. A cleaning solution as claims in claim 7, wherein the cleaning composition includes iodine as a further additive in an amount effective for providing a metal article cleaned by the cleaning solution with a shiny surface coating.

12. A cleaning solution as claimed in claim 11, wherein the cleaning composition includes approximately: 10% (m/m) iodine, 65% (m/m) tartaric acid, 5% (m/m) sodium lauryl sulphate and 20% (m/m) citric acid.

* * * * *